US007949272B2

(12) United States Patent
Ozaki

(10) Patent No.: US 7,949,272 B2
(45) Date of Patent: May 24, 2011

(54) IMAGE FORMING APPARATUS WITH CONTROL OF A CONTACT POSITION OF FIXING AND PRESSURE ROLLERS

(75) Inventor: Tatsuya Ozaki, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 367 days.

(21) Appl. No.: 12/107,497

(22) Filed: Apr. 22, 2008

(65) Prior Publication Data

US 2008/0279575 A1 Nov. 13, 2008

(30) Foreign Application Priority Data

May 8, 2007 (JP) ..... 2007-123040

(51) Int. Cl.
*G03G 15/20* (2006.01)

(52) U.S. Cl. ..... 399/67; 399/69; 399/318

(58) Field of Classification Search ..... 399/67
See application file for complete search history.

(56) References Cited

U.S. PATENT DOCUMENTS 7,120,371 B2 * 10/2006 Fujimori ..... 399/67

FOREIGN PATENT DOCUMENTS

JP 2004-109521 4/2004

* cited by examiner

*Primary Examiner* — David M Gray
*Assistant Examiner* — Roy Yi
(74) *Attorney, Agent, or Firm* — Oblon, Spivak, McClelland, Maier & Neustadt, L.L.P.

(57) ABSTRACT

A transfer unit transfers a toner image formed on an image carrier onto a recording medium. A fixing unit includes a fixing roller and a pressure roller for fixing the toner image onto the recording medium by applying heat and pressure to the recording medium. At least one driving unit drives the fixing roller and the pressure roller. When stopping the fixing roller, a control unit controls the driving unit to stop the fixing roller such that the fixing roller and the pressure roller make a contact with each other at a contact position different from a previous contact position.

17 Claims, 6 Drawing Sheets

IMAGE FORMING APPARATUS WITH CONTROL OF A CONTACT POSITION OF FIXING AND PRESSURE ROLLERS

CROSS-REFERENCE TO RELATED APPLICATIONS

The present application claims priority to and incorporates by reference the entire contents of Japanese priority document 2007-123040 filed in Japan on May 8, 2007.

BACKGROUND OF THE INVENTION

1. Field of the Invention

The present invention relates to an image forming apparatus and a control method of the same.

2. Description of the Related Art

An image forming apparatus, such as a copying machine, a facsimile machine, and a printer, includes a photosensitive element as an image carrier that rotates in the sub-scanning direction in accordance with an image of an original or image data of the image. The photosensitive element is uniformly charged by a charging unit, and exposed by an exposing unit to form an electrostatic latent image. The electrostatic latent image is developed by a developing unit using a toner to form a toner image, and the toner image is transferred by a transfer unit onto a sheet as a recording medium. The toner image on the sheet is then fixed by a fixing unit including a fixing roller with a heater and a pressure roller by applying heat and pressure.

The fixing roller and the pressure roller are in contact with each other with a predetermined pressure in the fixing unit. At this state, a contact width (a nip width) between the rollers needs to be maintained at an appropriate value. For example, Japanese Patent Application Laid-Open No. 2004-109521 discloses a conventional technology for providing a fixing unit of which the nip width can be changed to attain an appropriate nip width depending on types or thicknesses of sheets.

However, even in such a fixing unit, if the fixing roller and the pressure roller are stopped while being in contact with each other at the same position for a long time, the contact surfaces of the rollers are deformed to a flat shape. As a result, the circularity of the rollers is degraded to an irregular shape (flat spot state), resulting in a noise or a nonuniform fixing of the toner when the fixing roller and the pressure roller rotate.

SUMMARY OF THE INVENTION

It is an object of the present invention to at least partially solve the problems in the conventional technology.

According to an aspect of the present invention, there is provided an image forming apparatus including a transfer unit that transfers a toner image formed on an image carrier onto a recording medium; a fixing unit including a fixing roller and a pressure roller for fixing the toner image onto the recording medium by applying heat and pressure to the recording medium; at least one driving unit that drives the fixing roller and the pressure roller; and a control unit that performs, when stopping the fixing roller, a fixing-roller drive stop control of controlling the driving unit to stop the fixing roller such that the fixing roller and the pressure roller make a contact with each other at a contact position different from a previous contact position.

Furthermore, according to another aspect of the present invention, there is provided an image forming apparatus including a transfer unit that transfers a toner image formed on an image carrier onto a recording medium; a fixing unit including a fixing roller and a pressure roller for fixing the toner image onto the recording medium by applying heat and pressure to the recording medium; at least one driving unit that drives the fixing roller and the pressure roller; a switching unit that switches on and off a driving source of the driving unit; and a control unit that performs, when stopping the fixing roller, a fixing-roller drive stop control of controlling the driving unit and the switching unit to stop the fixing roller such that the fixing roller and the pressure roller make a contact with each other at a contact position different from a previous contact position.

Moreover, according to still another aspect of the present invention, there is provided an image forming apparatus including a transfer unit that transfers a toner image formed on an image carrier onto a recording medium; a fixing unit including a fixing roller and a pressure roller for fixing the toner image onto the recording medium by applying heat and pressure to the recording medium; at least one driving unit that drives the fixing roller and the pressure roller; and a control unit that controls, when a driving stop state of the fixing roller continues for a predetermined time, the driving unit to forcibly drive the fixing roller to move to a different stop position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
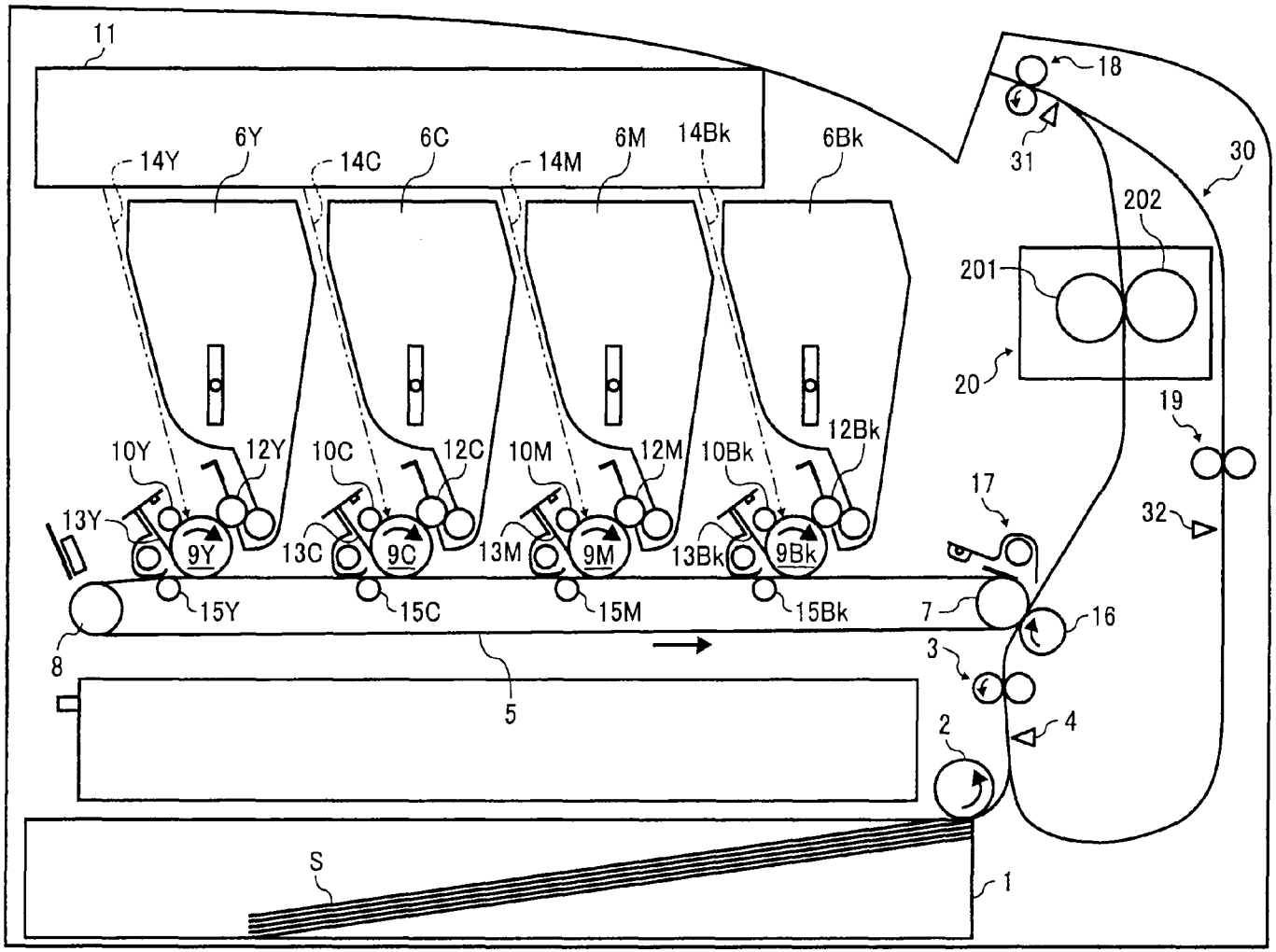
FIG. 1 is a schematic diagram of an image forming apparatus according to a first embodiment of the present invention.

FIG. 1 is a schematic diagram of an image forming apparatus according to a first embodiment of the present invention.

The image forming apparatus is a tandem-type image forming apparatus that includes all-in-one (AIO) cartridges 6K, 6M, 6C, 6Y serving as electrophotographic processing units (image forming units) for each color and aligned along a transfer belt 5 of a transfer unit. The AIO cartridge means such that includes typical elements necessary for image forming.

The transfer belt 5 rotates in a direction indicated by an arrow in FIG. 1 (a counterclockwise direction). The AIO cartridges 6K, 6M, 6C, 6Y are aligned in that order from an upstream side of the transfer belt 5. Each of the AIO cartridges 6K, 6M, 6C, 6Y is configured in the same manner except colors of toners for toner images to be formed. Specifically, the AIO cartridge 6K forms a black toner image, the AIO cartridge 6M forms a magenta toner image, the AIO cartridge 6C forms a cyan toner image, and the AIO cartridge 6Y forms a yellow toner image.

The AIO cartridge 6K is described in detail below. The AIO cartridges 6M, 6C, 6Y have the same configurations as that of the AIO cartridge 6K. Therefore, reference codes of M for magenta, C for cyan, and Y for yellow are assigned instead of Bk for black with the same reference numerals to the same constituent elements in the drawings, and the same explanations are not repeated.

The transfer belt 5 is an endless belt extended between a secondary-transfer drive roller 7 and a transfer-belt tension roller 8 that are driven to rotate. The secondary-transfer drive roller 7 is rotated by a driving motor as a driving source (not shown). The driving motor (not shown), the secondary-transfer drive roller 7, and the transfer-belt tension roller 8 serve as a driving unit that moves the transfer belt 5.

The AIO cartridge 6K includes a photosensitive element 9Bk, a charging device 10Bk as a charging unit arranged around the photosensitive element 9Bk, an exposure device 11 as an exposure unit, a developing device 12Bk as a developing unit, and a cleaner blade 13Bk as a cleaning unit.

The exposure device 11 is configured to apply laser lights 14Bk, 14M, 14C, 14Y as an exposure light corresponding to colors of images to be formed by the AIO cartridges 6K, 6M, 6C, 6Y, respectively.

The outer surface of the photosensitive element 9Bk is uniformly charged by the charging device 10Bk in a dark environment, and then exposed by the laser light 14Bk corresponding to a black image applied from the exposing device 11. As a result, an electrostatic latent image is formed.

The developing device 12Bk develops the electrostatic latent image by using black toner, and therefore, a black toner image is formed on the photosensitive element 9Bk.

The toner image is transferred on the transfer belt 5 by a primary transfer roller 15Bk at a position (primary transfer position) where the photosensitive element 9Bk comes in contact with the transfer belt 5. As a result, a black toner image is formed on the transfer belt 5.

When the toner image is transferred onto the transfer belt 5, the cleaner blade 13Bk removes residual toner from the outer surface of the photosensitive element 9Bk. Then, the photosensitive element 9Bk goes to a standby state for a next image forming process.

The transfer belt 5 is moved to convey a black toner image transferred by the AIO cartridge 6K in the above manner to a position of the AIO cartridge 6M.

The AIO cartridge 6M is subjected to the same processing as that of the AIO cartridge 6K. Accordingly, a magenta toner image is formed on the photosensitive element 9M, and then superimposed on the black image on the transfer belt 5.

The transfer belt 5 is continuously moved to convey the superimposed image to the AIO cartridges 6C, 6Y. Accordingly, a cyan toner image formed on the photosensitive element 9C and a yellow toner image formed on the photosensitive element 9Y are sequentially superimposed on the transfer belt 5 in the above manner.

The transfer belt 5 is moved to convey a superimposed full-color image on the transfer belt 5 to a position of a secondary transfer roller 16.

When a monochrome color image is formed using black toner, primary transfer rollers 15M, 15C, 15Y are placed at positions away from the photosensitive elements 9M, 9C, 9Y, respectively, and the above image processing is performed only on the photosensitive element 9Bk.

A sheet S on the top of sheets stacked in a sheet feed tray 1 is conveyed by rotating a sheet feed roller 2 in a direction indicated by an arrow in FIG. 1 (a counterclockwise direction), and stopped at a position of a registration roller 3. A timing to stop conveying the sheet S corresponds to a timing when a predetermined time elapses after a registration sensor 4 detects a leading edge of the sheet S.

The registration roller 3 is started to rotate so that the toner image transferred by the transfer belt 5 comes in contact with the sheet S at a position of the secondary transfer roller 16. At this state, the registration roller 3 rotates in a direction indicated by an arrow in FIG. 1 (a counterclockwise direction) to convey the sheet S.

The sheet S conveyed by the registration roller 3 is subjected to processing of transferring the toner image from the transfer belt 5 to the sheet S by the secondary transfer roller 16. The toner image is fixed onto the sheet S due to heat and pressure by a fixing unit 20, and the sheet S is neutralized to an outside of the image forming apparatus by a neutralizing roller 18 rotated in a direction indicated by an arrow in FIG. 1 (counterclockwise direction).

After the toner image is transferred from the transfer belt 5 to the sheet S, a belt cleaner 17 removes residual toner from the surface of the transfer belt 5, and the transfer belt 5 goes to a standby state for a next image forming process.

When in a double-side mode in which an image is formed on both sides of the sheet S, the neutralizing roller 18 is rotated in a clockwise direction before the sheet S passes through the neutralizing roller 18 (i.e., at a timing when the sheet S is not detected by a neutralizing sensor 31) to convey the sheet S to a double-side conveying path 30.

The sheet S conveyed to the double-side conveying path 30 passes through a double-side roller 19, detected by a double-side sensor 32, and conveyed to the registration roller 3.

The sheet S conveyed to the registration roller 3 is re-fed from the registration roller 3, and a toner image is transferred on a reversed side of the sheet S by the secondary transfer roller 16. The toner image is fixed onto the sheet S due to heat and pressure by the fixing unit 20, and the sheet S is neutralized to an outside of the image forming apparatus by the neutralizing roller 18 rotated in a direction indicated by the arrow shown in FIG. 1.

Figure 2:
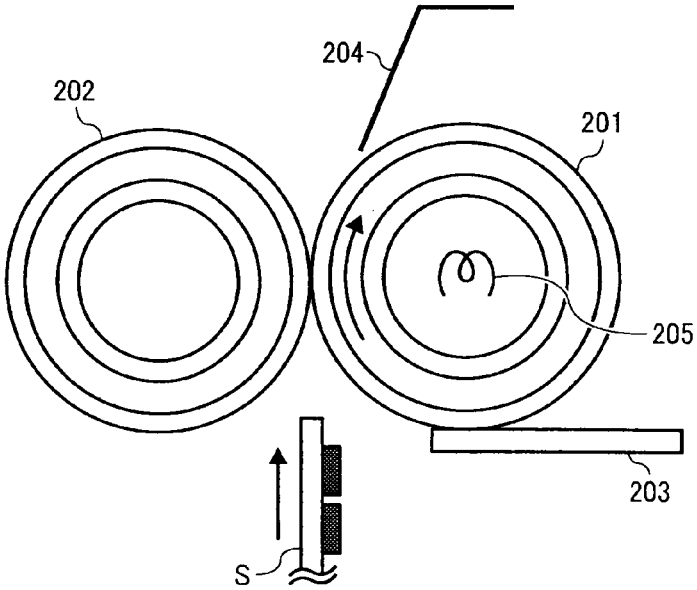
FIG. 2 is a schematic diagram of a fixing unit shown in FIG. 1.

FIG. 2 is a schematic diagram of the fixing unit 20.

A fixing roller 201 is formed by coating rubber around a cored bar made of aluminum, and accommodates a heater 205.

A pressure roller 202 is also formed by coating rubber around a cored bar made of aluminum, and comes in contact with the fixing roller 201 with a predetermined pressure (a contact portion is described as "nip portion" in the following explanation).

The pressure roller 202 in contact with the fixing roller 201 is rotated by driving (rotating) the fixing roller 201 by a driving mechanism (driving unit) (not shown). The toner image secondary transferred on the sheet S is fixed onto the sheet S due to heat and pressure while the sheet S passes between the fixing roller 201 and the pressure roller 202.

After the sheet S passes through the nip portion, the sheet S often adheres to the fixing roller 201 due to toner melted by heat. To peel off the sheet S from the fixing roller 201, a separating plate 204 is arranged on a downstream side of the nip portion.

A surface temperature (fixing temperature) of the fixing roller 201 is detected by a thermistor 203, and controlled to an appropriate temperature depending on an operational state such as an image forming state or a standby state.

Figure 3:
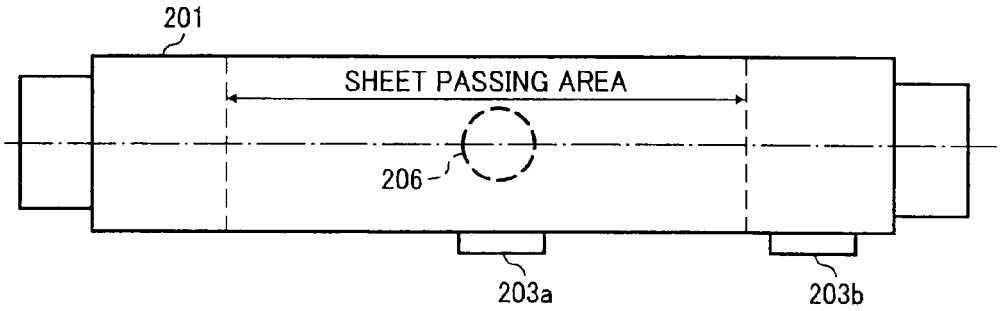
FIG. 3 is a schematic diagram for explaining a positional relation between a fixing roller and a thermistor shown in FIG. 2.

FIG. 3 is a schematic diagram for explaining a positional relation between the fixing roller 201 and the thermistor 203.

The thermistor 203 includes a central-temperature detection thermistor 203*a* and a peripheral-temperature detection thermistor 203*b*. The central-temperature detection thermistor 203*a* is arranged on a center portion of a sheet passing area along an axial direction of the fixing roller 201 (a direction perpendicular to a direction of conveying the sheet S), and the peripheral-temperature detection thermistor 203*b* is arranged on a peripheral portion of the thermistor 203.

The fixing roller 201 accommodates a thermostat 206. The thermostat 206 is provided to electrically deenergize electricity when a software control is in a stalled state. Specifically, the thermostat 206 terminates energization of the heater 205 when a predetermined temperature or higher is continued.

Figure 4:
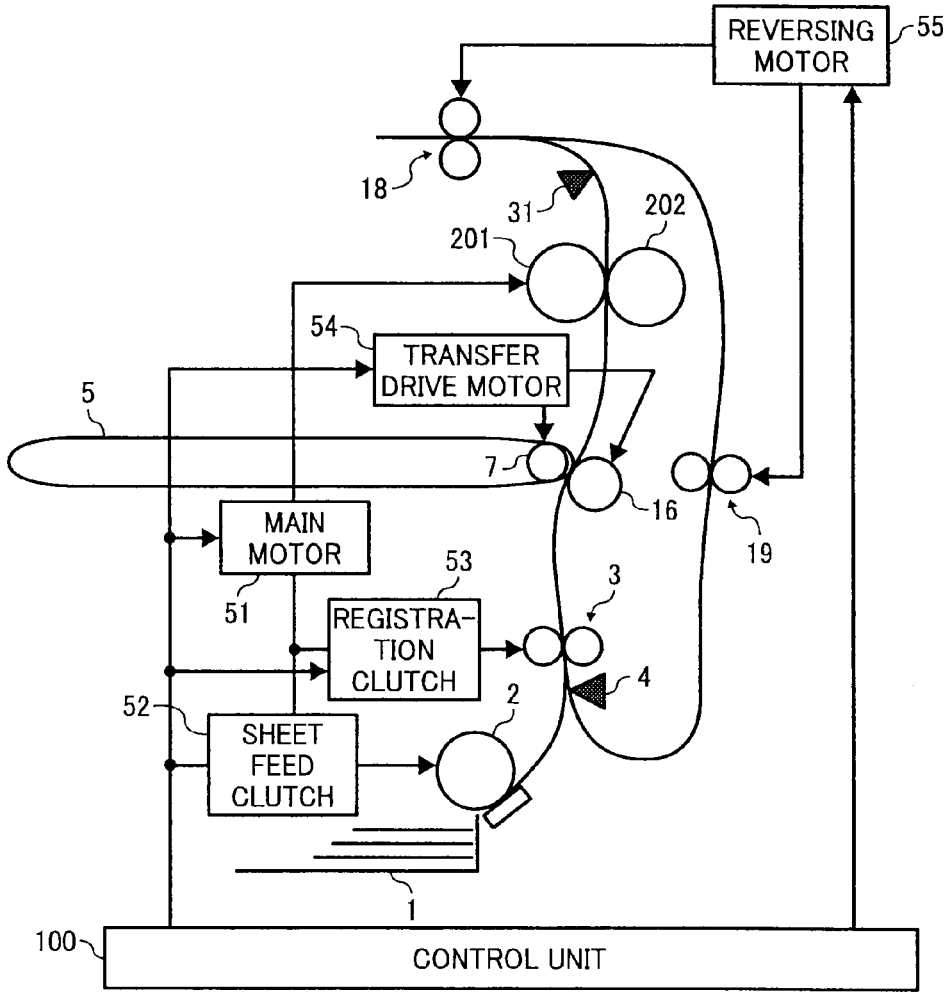
FIG. 4 is a schematic diagram of an example of a driving mechanism for a fixing roller and a sheet transfer member shown in FIG. 1 and a control unit that controls the driving mechanism.

FIG. 4 is a schematic diagram of a driving mechanism for the fixing roller 201 and a sheet transfer member and a control unit that controls the driving mechanism.

The driving mechanism drives the sheet feed roller 2, the registration roller 3, and the fixing roller 201 by using a main motor 51.

A sheet feed clutch 52 is arranged for the sheet feed roller 2, and a registration clutch 53 is arranged for the registration roller 3. By switching ON/OFF the sheet feed clutch 52 and the registration clutch 53, driving power from the main motor 51 to the sheet feed roller 2 and the registration roller 3 is controlled to be ON/OFF to drive or stop the sheet feed roller 2 and the registration roller 3, respectively.

A transfer drive motor 54 drives the secondary-transfer drive roller 7 and the secondary transfer roller 16.

A reversing motor 55 drives the neutralizing roller 18 and the double-side roller 19. Specifically, when the sheet S is neutralized in a normal state, the reversing motor 55 drives the rollers 18, 19 in a normal direction. On the other hand, when the sheet S is conveyed to the double-side conveying path 30 in a double-side mode, the reversing motor 55 drives the rollers 18, 19 in a reverse direction.

A control unit 100 is a typical microcomputer that includes a central processing unit (CPU), a read only memory (ROM), a random access memory (RAM), a clock timer, a nonvolatile memory, and the like.

The control unit 100 controls each output unit, such as the main motor 51, the sheet feed clutch 52, the registration clutch 53, the transfer drive motor 54, the reversing motor 55, and the heater 205, based on a signal from each input unit, such as the registration sensor 4, the sheet neutralizing sensor 31, the double-side sensor 32, and the thermistor 203. As a result, the control unit 100 controls various operations including an image forming operation.

The CPU in the control unit 100 executes a computer program stored in a storage device such as the ROM and a hard disk drive (not shown) to realize functions of a control unit, a fixing-temperature detecting unit, and a time changing unit by using the RAM, the clock timer, the nonvolatile memory, and the thermistor 203 in the control unit 100.

A first embodiment of the present invention is described below with reference to FIGS. 4 to 6.

As shown in FIG. 4, the fixing roller 201 and the pressure roller 202 of the fixing unit 20 are configured to rotate by driving the main motor 51 in the image forming apparatus according to the first embodiment.

Figure 5:
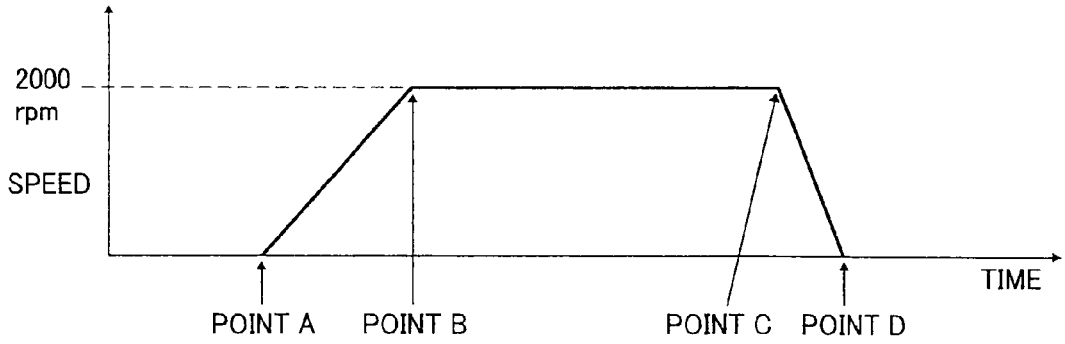
FIG. 5 is a graph of change of a driving speed of a main motor shown in FIG. 4 with respect to time.

FIG. 5 is a graph of change of a driving speed (rotation speed) of the main motor 51 with respect to time.

The main motor 51 generally employs a brushless direct-current (DC) motor. When the main motor 51 is activated, its rotation frequency (rotation speed) gradually increases to a predetermined speed (a desired constant speed) at a speed in accordance with a line shown in FIG. 5. Similarly, when the main motor 51 is stopped, its rotation frequency gradually degreases at a speed in accordance with a line shown in FIG. 5. The control unit 100 measures a driving time of the main motor 51 to calculate (detect) an actual rotation frequency (rotation speed) and a rotation angle of the fixing roller 201.

Assuming that the predetermined speed of the main motor 51 is 2,000 revolutions per minute (rpm), and the rotation axis of the main motor 51 and the fixing roller 201 are connected to drive in a interlinked manner by gears (not shown) and belts (not shown) arranged with a previously determined gear ratio. In this example, the rotation axis of the main motor 51 rotates forty times while the fixing roller 201 rotates one time. Furthermore, it is assumed that a rise time (from point A to point B) of the main motor 51 is 200 milliseconds and its fall time (from point C to point D) is 50 milliseconds. Actual measured values are applied to the rise time, the fall time, and the rotation frequency of the main motor 51 during the rise time and the fall time in the below explanation. Specifically, the main motor 51 rotates 8 times during the rise time and 2 times during the fall time.

If a time from point B to point C in which the main motor 51 rotates at the predetermined speed (2,000 rpm) is 90 seconds, the rotation axis of the main motor 51 rotates 3,000 times (3,000=2,000×90/60); therefore, the main motor 51 rotates 3,010 times in total (3,010=8+3000+2). At this state, the fixing roller 201 rotates 75.25 times (75.25=3,010/40). As a result, the fixing roller 201 stops at a position 90 degrees shifted from a position before rotation.

Figure 6:
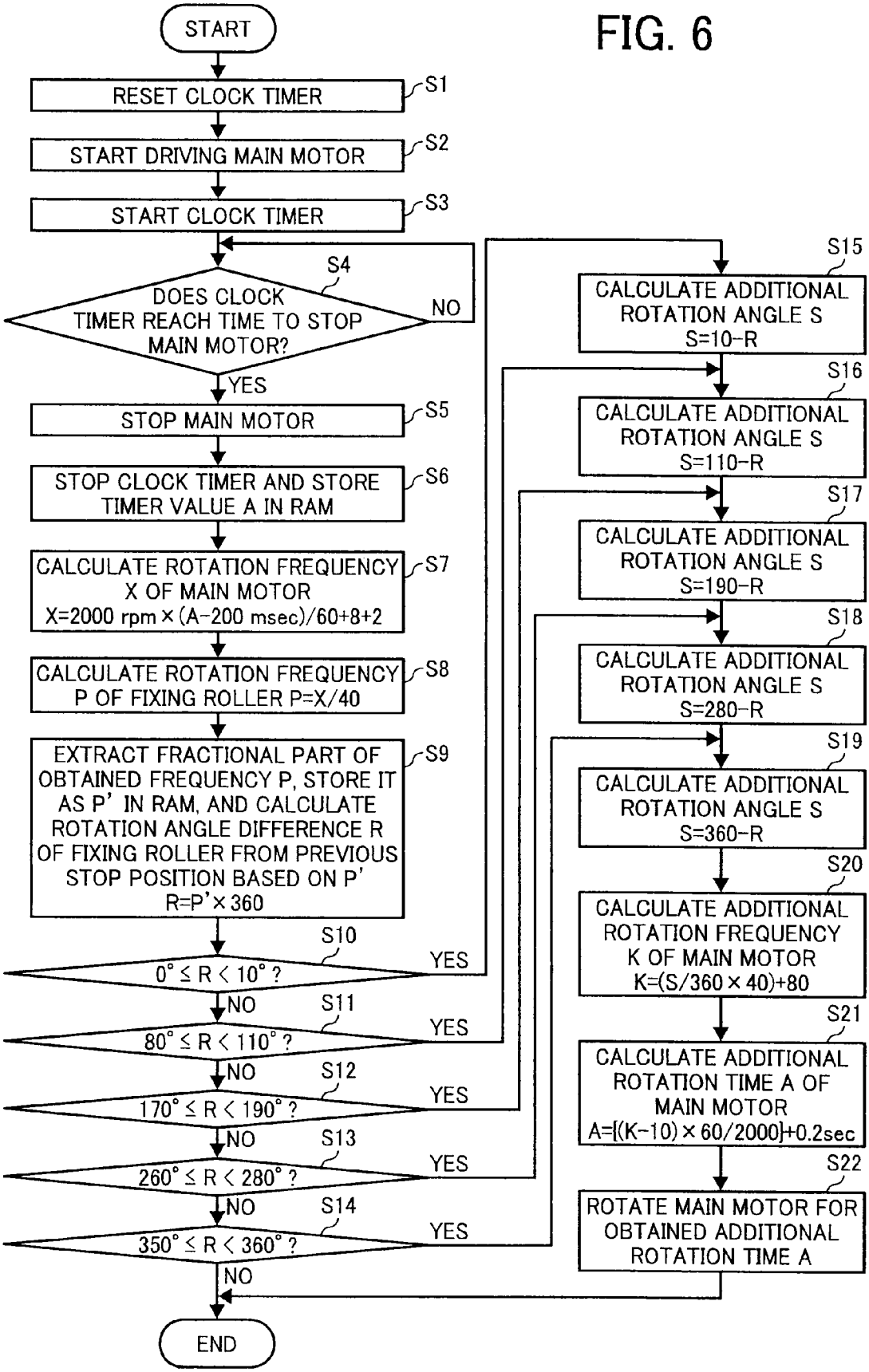
FIG. 6 is a flowchart of a control process performed by a control unit shown in FIG. 4.

FIG. 6 is a flowchart of a control process including a drive control of the fixing roller 201 performed by the control unit 100. Explanations and drawings in connection with control processing other than the drive control processing of the fixing roller 201 in a normal operation (image forming operation) are omitted.

Upon acquiring an instruction of start of the normal operation, the control unit 100 starts a processing routine shown in FIG. 6, and resets a clock timer (not shown) (Step S1).

The control unit 100 starts driving the main motor 51 (Step S2), and activates the clock timer to start measuring a time (timer start) (Step S3). The control unit 100 determines whether the timer has reached a time to stop driving of the main motor 51 (Step S4). If the time has not reached the timing (No at Step S4), because the main motor 51 is driving (rotating), the control unit 100 continuously causes the clock timer to measure the time. When the time has reached the timing (Yes at Step S4), the control unit 100 stops driving of the main motor 51 (Step S5). Then, the control unit 100 stops measuring the time by the clock timer (timer stop), and stores the measured time as a timer value A in a RAM or a nonvolatile memory (Step S6).

The control unit 100 calculates the rotation frequency of the main motor 51 (Step S7).

Specifically, assuming that the rise time of the main motor 51 is fixed at 200 milliseconds, the time in which the main motor 51 has driven at the predetermined speed corresponds to A−200 milliseconds. Furthermore, assuming that the main motor 51 rotates 8 times during the rise time and 2 times during the fall time, the actual rotation frequency X of the main motor 51 is obtained by X=2,000 rpm×(A−200 milliseconds)/60+8+2.

The control unit 100 calculates a rotation frequency P of the fixing roller 201 by P=X/40 (Step S8).

The control unit 100 calculates a rotation angle difference R of the fixing roller 201 between a current stop position and a stop position before driving (previous stop position) from the rotation frequency P (Step S9). Specifically, the control unit 100 extracts a fractional part of the rotation frequency P of the fixing roller 201, and stores the fractional part as P' in the RAM. Then, the control unit 100 calculates the rotation angle difference R by R=P'×360.

The control unit 100 checks whether the calculated rotation angle difference R is within a previously determined angular range at Steps S10 to S14.

The angular range is determined so that the fixing roller 201 does not stop at the same position frequently. For example, the rotation angle difference R of 180 degrees is excluded from the angular range, because the fixing roller 201 stops at the same position once in two operations when the rotation angle difference R is 180 degrees.

Specifically, the control unit 100 checks whether the rotation angle difference R is within each of the angular ranges of 10°≦R<80°, 110°≦R<170°, 190°≦R<260°, and 280°≦R<350°.

If the rotation angle difference R is not in the above ranges, that is, if it is in one of the ranges of 0°≦R<10°, 80°≦R<110°, 170°≦R<190°, 260°≦R<280°, and 350°≦R<360°, the control unit 100 performs processing to additionally drive the fixing roller 201. At this time, the stop position of the main motor 51 can be shifted to a desired position by driving the main motor 51 at the predetermined speed for a time previously calculated to stop the fixing roller 201 at a desired position.

An additional rotation angle S of the fixing roller 201 is calculated in the following manner. If the rotation angle difference R is 0°≦R<10°, S=10−R (Step S15); if the rotation angle difference R is 80°≦R<110°, S=110−R (Step S16); if the rotation angle difference R is 170°≦R<190°, S=190−R (Step S17); if the rotation angle difference R is 260°≦R<280°, S=280−R (Step S18); and if the rotation angle difference R is 350°≦R<360°, S=360−R (Step S19).

The control unit 100 calculates an additional rotation frequency K of the main motor 51 by K=(S/360×40)+80 (Step S20), and an additional rotation time A of the main motor 51 by A={(K−10)×60/2,000}+0.2 seconds (Step S21). The control unit 100 then additionally drives (rotates) the main motor 51 for the calculated additional rotation time (Step S22), and process control ends.

For example, if a stop angle difference between stop positions of the fixing roller 201 before/after the normal operation is 5 degrees, the stop position needs to be further shifted by 5 degrees. In this case, the fixing roller 201 needs to be rotated the number of times calculated by 5/360=0.0138. The rotation frequency of the main motor 51 is forty times larger than the rotation frequency of the fixing roller 201; therefore, the main motor 51 needs to be rotated 0.55 time. However, because the main motor 51 takes the rise time and the fall time, the rotation at the frequency of 0.55 is not enough. Specifically, it is preferable to rotate the main motor 51 for 80 times at minimum, thus 80.55 times in total. With this condition, the fixing roller 201 is rotated 2 times, thus 2+0.0138 times in total.

If assuming that the rotation frequency X of the main motor 51 is 80.55, the additional rotation time A for additionally driving the main motor 51 is calculated by A={(80.55−10)×60/2,000}+0.2 seconds=2.3165 seconds. Therefore, if the main motor 51 is additionally rotated for 2.3165 seconds, the fixing roller 201 is rotated by 5 degrees of the rotation angle. Thus, the stop position of the fixing roller 201 is shifted by 10 degrees from the previous stop position.

As described above, when stopping driving of the fixing roller 201 at an end of the normal operation, a fixing-roller driving stop control is performed to control the main motor 51 so that the contact position between the fixing roller 201 and the pressure roller 202 is different from a previous contact position. Therefore, the fixing roller 201 and the pressure roller 202 do not stop at the same contact position. Thus, it is possible to prevent a flat spot on the fixing roller 201 and the pressure roller 202.

According to the first embodiment, the driving time of the fixing roller 201 from a start of the normal operation to an end of the normal operation is measured. Whether the fixing roller 201 and the pressure roller 202 stop at a contact position different from a contact position of before the normal operation is checked based on the measured time. If the fixing roller 201 and the pressure roller 202 stop at the same contact position as the previous stop position (a position closed to the previous stop position is included), the fixing roller 201 is further rotated for a short time. That is, the fixing-roller driving stop control is performed while the rotation of the fixing roller 201 is suspended to change the contact position of the fixing roller 201 and the pressure roller 202. Alternatively, it is possible to perform the fixing-roller driving stop control without suspending the driving of the fixing roller 201 as described below in a second embodiment of the present invention.

In the processing described in the first embodiment, if the difference between the previous stop position and the current stop position of the fixing roller 201 is not within a predetermined range after driving the main motor 51 in the normal operation, the current stop position is shifted by additionally driving the main motor 51. Alternatively, according to the second embodiment, the stop position is calculated just before stopping the main motor 51 during the normal operation (at point C in FIG. 5) by obtaining the number of times for additionally rotating the main motor 51 as described in the first embodiment.

Furthermore, although the rise time and fall time need to be considered to re-drive the suspended main motor 51 for additional rotation in the first embodiment, the fixing roller 201 can be stopped at a desired position only by slightly increasing the time for driving at the predetermined speed in the second embodiment.

Specifically, it is determined by performing a calculation similar to that in the first embodiment that the main motor 51 needs to be additionally rotated 0.55 times. Therefore, an extended amount of time B is obtained by B=(0.55×60/2,000)=0.0165 [sec]. Thus, the rotation needs to be extended for 16.5 milliseconds.

As described above, by calculating a driving time of the fixing roller 201 from a start of the normal operation to an end of the normal operation just before finishing the normal operation, the rotation angle of the fixing roller 201 at the time of stop of the image forming operation can be obtained. The driving time of the fixing roller 201 is slightly adjusted based on the obtained driving time so that the contact position of the fixing roller 201 and the pressure roller 202 is different from the previous contact position. That is, the fixing-roller driving stop control is performed. As a result, it is possible to attain the same effect as that in the first embodiment. Furthermore, the rotation of the fixing roller 201 does not need to be suspended. Therefore, it is possible to reduce load on the control unit 100.

A third embodiment of the present invention is to consider an operation mode of the normal operation (image forming operation).

Assuming that an image forming apparatus according to the third embodiment includes a printing mode that executes a printing at a lower speed than a normal speed to increase fixability of a printed image when a sheet to be used for image forming (printing) is thick like a cardboard.

According to the third embodiment, a stop position of the fixing roller 201 can be accurately calculated even if the sheet is the cardboard.

For example, if a printing speed is decreased to be half for printing the cardboard, the rotation speed of the main motor 51 is changed to 1,000 rpm, and the rise time and the fall time are also changed.

The stop position of the fixing roller 201 is controlled in consideration with the above condition. The actual values of the rotation speed, the rise time, and the fall time in the control processing according to the third embodiment are different from those in the first and the second embodiments, but processing procedures are the same. Thus, the same explanations are not repeated.

As described above, the operation mode of the normal operation is considered to perform the fixing-roller driving stop control. Therefore, it is possible to prevent a flat spot on the fixing roller 201 and the pressure roller 202 even in a low-speed operation mode.

A fourth embodiment of the present invention is described below.

When the fixing roller 201 is irregularly stopped (e.g., due to a sheet jam) during the normal operation, the difference between the stop position at the time of an irregular stop and the previous stop position can be calculated and stored in a nonvolatile memory. The previous stop position (a position before starting the normal operation) is also stored (not deleted) in the nonvolatile memory.

The irregular stop state is generally resolved by a user. In some cases, the irregular stop state is even remained as it is.

According to the fourth embodiment, when the irregular stop state occurs, a timer is started to measure a time how long the irregular stop state continues.

If the irregular stop state continues for a predetermined time, a stop position at the time of the irregular stop of the fixing roller 201 (a contact position of the fixing roller 201 and the pressure roller 202 at the time of the irregular stop) is determined as a new stop position.

When the irregular stop state is resolved and the main motor 51 is re-driven, the new stop position is considered as the previous stop position at the time of an end of the next normal operation. Therefore, the fixing roller 201 is controlled to stop at a position shifted from the new stop position.

If the irregular stop position continues for less than the predetermined time, the stop position of the fixing roller 201 before the start of the normal operation is determined as the previous stop position. As a result, the fixing roller 201 is controlled to stop at a position shifted from the previous stop position in the manner described above.

As described above, a time measurement is started when the irregular stop state occurs during the normal operation (e.g., the fixing roller 201 is suspended for emergency due to a sheet jam). When the irregular stop state continues for a predetermined time, the contact position of the fixing roller 201 and the pressure roller 202 at the time of the irregular stop is considered as the new stop position. When the next normal operation ends, the new stop position is considered as the previous stop position to control the fixing roller 201 to stop at a position different from the new stop position. As a result, even when the rollers stop for emergency due to occurrence of the irregular state, a flat spot on the fixing roller 201 and the pressure roller 202 can be prevented.

A fifth embodiment of the present invention is described below with reference to FIG. 7. Configurations of the fixing roller 201 and the driving mechanism of the sheet feed mechanism are different from those shown in FIG. 4.

Figure 7:
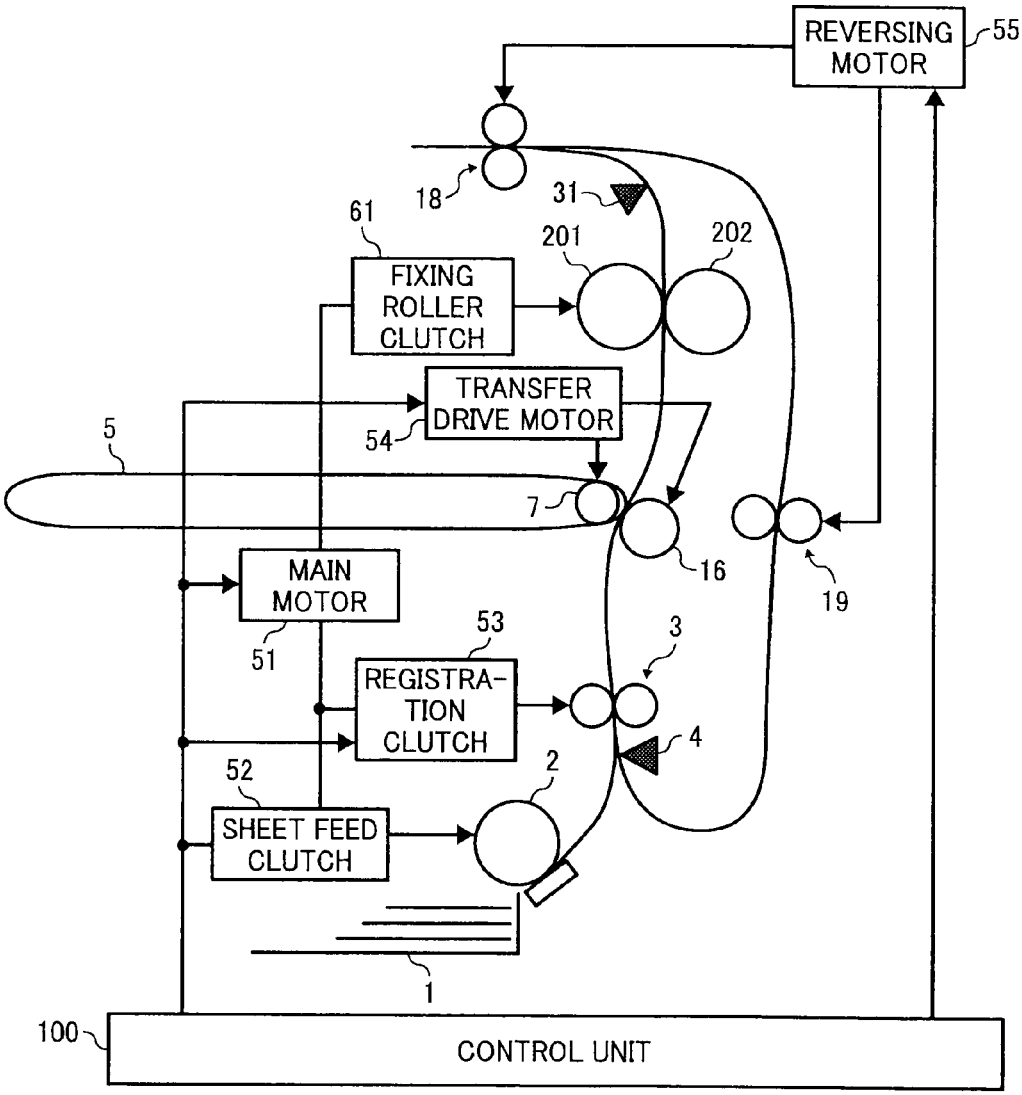
FIG. 7 is a schematic diagram of another example of the driving mechanism and the control unit shown in FIG. 4.

FIG. 7 is a schematic diagram of another example of the fixing roller 201, the driving mechanism of the sheet feed mechanism, and the control unit 100. The same reference numerals are assigned to the same constituent elements shown in FIG. 4, and the same explanations are not repeated.

The driving mechanism shown in FIG. 7 includes, in addition to the configuration shown in FIG. 4, a fixing roller clutch 61 arranged between the main motor 51 and the fixing roller 201 to control ON/OFF of the driving power of the main motor 51.

Figure 8A:
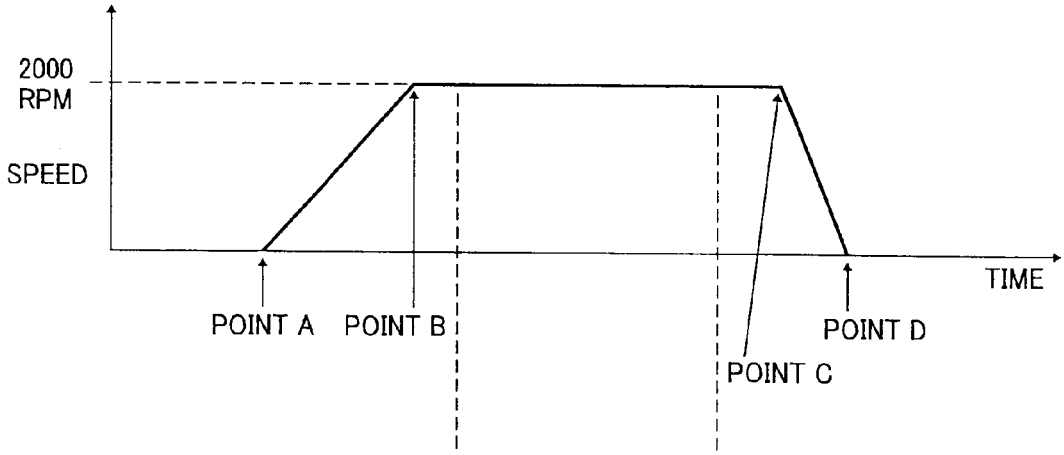
FIG. 8A is a graph of change of a driving speed of a main motor shown in FIG. 7 with respect to time.
Figure 8B:
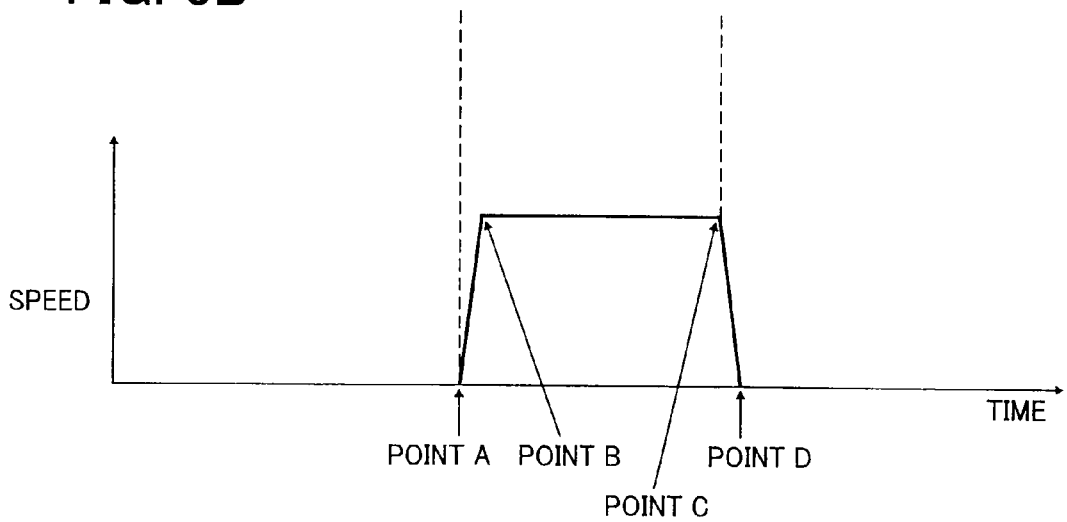
FIG. 8B is a graph of change of a driving speed of a fixing roller shown in FIG. 7 with respect to time.

FIG. 8A is a graph of change of the driving speed of the main motor 51 with respect to time; and FIG. 8B is a graph of change of the driving speed of the fixing roller 201 with respect to time.

According to the first to the fourth embodiment, the fixing roller 201 is controlled in accordance with a driving speed curve of the main motor 51 shown in FIG. 8A that corresponds to a driving speed curve of the fixing roller 201. On the other hand, according to the fifth embodiment, because the fixing roller clutch 61 as a connection/disconnection switching unit is included, the driving speed curve of the fixing roller 201 corresponds to the curve shown in FIG. 8B.

The control unit 100 turns ON the fixing roller clutch 61 when the rotation speed of the main motor 51 corresponds to the predetermined speed. Due to this, the rotation speed of the fixing roller 201 does not require a large amount of rise time as described in the first to the fourth embodiments. The fixing roller clutch 61 generally employs an electromagnetic clutch. Therefore, when the clutch is turned ON, several tens milliseconds are necessary to shift the clutch to a full ON state. The turning OFF of the fixing roller clutch is also performed while the main motor 51 rotates at the predetermined speed. When the clutch is turned OFF, several tens milliseconds are necessary to shift the clutch to a full OFF state similarly to the turning ON.

Assuming that the rise time of the fixing roller 201 is 80 milliseconds, and the fall time is 40 milliseconds. Furthermore, assuming that the rotation axis of the main motor 51 rotates 3.2 times during the rise time, and 1.6 times during the fall time. The time from turning ON of the fixing roller clutch 61 to turning OFF of the fixing roller clutch 61 is assumed as C. At this state, the rotation frequency Q of the fixing roller 201 is calculated by $Q=\{2{,}000\times(C-80 \text{ milliseconds})/60+3.2+1.6\}/40$.

The subsequent control processing is the same as that described in the first embodiment, and the same explanation is not repeated.

According to the fifth embodiment, when the rotation of the fixing roller 201 is stopped, the fixing-roller driving stop control for controlling the main motor 51 and the fixing roller clutch 61 is performed so that the contact position of the fixing roller 201 and the pressure roller 202 at the time of stop is different from the previous stop (contact) position. Therefore, the fixing roller 201 and the pressure roller 202 are hardly stopped at the same contact position. Thus, the same effect as described in the first embodiment can be attained.

A sixth embodiment of the present invention is described below. The configurations of the fixing roller 201 and the driving mechanism of the sheet feed mechanism are the same as shown in FIG. 7.

The control processing according to the sixth embodiment is substantially the same as that described in the second embodiment (only the control of the fixing roller clutch 61 is added).

According to the sixth embodiment, when the driving of the fixing roller 201 is stopped, the fixing-roller driving stop control for controlling the main motor 51 and the fixing roller clutch 61 is performed so that the contact position of the fixing roller 201 and the pressure roller 202 at the time of stop is different from the previous stop (contact) position. Therefore, the fixing roller 201 and the pressure roller 202 do not stop at the same contact position. Thus, the same effect as described in the second embodiment can be attained.

A seventh embodiment of the present invention is described below. The configurations of the fixing roller 201 and the driving mechanism of the sheet feed mechanism are the same as shown in FIG. 7.

The control processing according to the seventh embodiment is substantially the same as that described in the third embodiment (only the control of the fixing roller clutch 61 is added).

It is noted that the driving speed of the main motor 51 is changed, and the fixing roller clutch 61 performs the driving ON/OFF control in the seventh embodiment. Therefore, the rise time and the fall time of the fixing roller are changed.

According to the seventh embodiment, the fixing-roller driving stop control is performed in consideration with the operation mode of the normal operation. Therefore, the same effect as described in the third embodiment can be attained.

An eighth embodiment of the present invention is described below. The configurations of the fixing roller 201 and the driving mechanism of the sheet feed mechanism are the same as shown in FIG. 7.

The control processing according to the eighth embodiment is substantially the same as that described in the fourth embodiment (only the control of the fixing roller clutch 61 is added).

It is noted that the fixing roller clutch 61 performs the driving ON/OFF control in the eighth embodiment, and therefore, the rise time and the fall time of the fixing roller are changed.

According to the eighth embodiment, a time measurement is started when the irregular stop state occurs during the normal operation. When the irregular stop state continues for a predetermined time, the contact position of the fixing roller 201 and the pressure roller 202 at the time of the irregular stop is considered as the new stop position. When the normal operation ends, the new stop position is considered as the previous stop position. Therefore, the fixing roller 201 is controlled to stop at a position different from the new stop position to change the contact position of the fixing roller 201 and the pressure roller 202. As a result, the same effect as described in the fourth embodiment can be attained.

A ninth embodiment of the present invention is described below.

According to the first to the eighth embodiments, the stop position after the fixing roller 201 is driven during the normal operation is controlled.

On the other hand, according to the ninth embodiment, when the image forming apparatus is remained in a standby state (apparatus suspended state) for a long time, the fixing roller 201 is automatically rotated to shift the contact position of the fixing roller 201 and the pressure roller 202.

The control unit 100 starts the timer when the image forming apparatus is changed to the standby state and measures a time of the standby state.

When the standby state continues for a predetermined time, the control unit 100 drives the fixing roller 201 to shift the contact position of the fixing roller 201 and the pressure roller 202. The driving time for shifting the contact position is calculated in the manner described in the first and the fifth embodiments. Specifically, the fixing roller 201 is suspended, and then the contact position is shifted.

For example, when it is desired to rotate the fixing roller 201 by 10 degrees from the current stop position, the fixing roller 201 needs to be rotated the number of times calculated by 10/360=0.027. At this state, the main motor 51 needs to be rotated the number of times calculated by 40×0.027=1.11.

Because the main motor 51 takes the rise time and the fall time, the rotation at the frequency of 1.11 is not enough. For example, it is preferable to rotate the main motor 51 for 80 times at minimum. Thus, the fixing roller 201 is rotated 2 times, thus 2+0.027 times in total.

At this state, if 81.11 is substituted for X (actual rotation frequency of the main motor 51) of "X=2,000 rpm×(A−200 milliseconds)/60+8+2" described in the first embodiment, the driving time T of the main motor 51 is calculated by T={(81.11−10)×60/2,000}+0.2 seconds=2.333 seconds. Thus, by rotating the main motor 51 for 2.333 seconds, the fixing roller 201 is shifted by 10 degrees of the rotation angle. As a result, the fixing roller 201 is shifted by 10 degrees from the previous stop position.

If the fixing roller clutch 61 is used, the same calculation as described in the fifth embodiment is applicable.

As described above, when the driving suspended state of the fixing roller 201 continues for a predetermined time, the fixing roller 201 is forcibly driven to control the main motor 51 and/or the fixing roller clutch 61 so that the fixing roller 201 and the pressure roller 202 stop at the contact position different from the previous position. As a result, the same effect as described in the first embodiment can be attained.

A tenth embodiment of the present invention is described below.

If the fixing roller 201 and the pressure roller 202 are stopped at the same contact position for a long time, the contact position tends to be changed to a flat shape. As the temperature of the fixing roller 201 and the pressure roller 202 increase, the time until the shape is changed decreases (i.e., the shape is easily changed as the temperature increases).

According to the tenth embodiment, the below control is performed in addition to the control described in the ninth embodiment. Specifically, the surface temperature of the suspended fixing roller 201 is detected by the thermistor 203, and the predetermined time (see the ninth embodiment), that is, a time to start a rotation driving for shifting the contact position of the fixing roller 201 and the pressure roller 202, is changed based on the detected temperature.

As described above, the temperature of the fixing roller at the time of suspension of its driving is detected, and the predetermined time is changed based on the detected temperature. Therefore, it is possible to assuredly prevent a flat spot on the fixing roller 201 and the pressure roller 202.

A stepping motor, a servomotor, and the like can be employed as the main motor 51 in addition to the brushless DC motor.

A computer program according to the present invention causes a CPU that controls the image forming apparatus such as a copying machine to execute functions of a control unit, a fixing-temperature detecting unit, and a time changing unit. As a result, the same effect as described above can be attained.

The computer program can be previously stored in a storage unit, such as a ROM or an HDD, or can be provided using a recording medium, such as a CD-ROM, a flexible disk, a magneto optical disk, a CD-R, a CD-RW, a DVD+R, a DVD+RW, a DVD-R, a DVD-RW, or a nonvolatile memory, such as a DVD-RAM, an EEPROM, or a memory card.

The processing described above can be realized by installing the computer program stored in the nonvolatile memory to the image forming apparatus to cause the CPU to execute the computer program, or by causing the CPU to load and execute the computer program from the nonvolatile memory.

It is also possible to download via the network the computer program from an external device including a recording medium having the computer program thereon, or from the external device including a storage unit that stores therein the computer program.

As described above, according to an aspect of the present invention, it is possible to prevent a flat spot on the fixing roller and the pressure roller in the fixing unit. Therefore, it is possible to provide an image forming apparatus having a fixing unit with a long product cycle. The present invention can be applied to an apparatus having two or more rollers of which shape may be changed because they are driven in contact with each other by pressure.

Furthermore, according to another aspect of the present invention, the image forming apparatus performs the fixing-roller driving stop control so that when stopping the driving of the fixing roller in the fixing unit, the contact position of the fixing roller and the pressure roller is shifted from the previous contact position. Therefore, the fixing roller and the pressure roller do not stop at the same contact position. As a result, a flat spot on the fixing roller and the pressure roller can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a transfer unit that transfers a toner image formed on an image carrier onto a recording medium;

a fixing unit including a fixing roller and a pressure roller that fix the toner image onto the recording medium by applying heat and pressure to the recording medium;

at least one driving unit that drives the fixing roller and the pressure roller; and a control unit that performs, when stopping the fixing roller, a fixing-roller drive stop control that calculates a rotation angle difference between a current contact position and a previous contact position of the fixing roller and the pressure roller and, when the rotation angle difference is outside a predetermined range, controls the driving unit to stop the fixing roller such that the fixing roller and the pressure roller make a contact with each other at a contact position different from the previous contact position.

2. The image forming apparatus according to claim 1, wherein the control unit controls the driving unit to suspend a driving of the fixing roller, and performs the fixing-roller drive stop control in a state in which the driving of the fixing roller is suspended.

3. The image forming apparatus according to claim 1, wherein the control unit performs the fixing-roller drive stop control by adjusting a driving time of the fixing roller based on the calculated rotation angle difference.

4. The image forming apparatus according to claim 3, wherein the control unit performs the fixing-roller drive stop control based on an operation mode of the image forming operation.

5. The image forming apparatus according to claim 3, wherein the control unit includes a timer unit that measures a time from an irregular stop during an image forming operation, and when the time from the irregular stop continues for a predetermined time, the control unit determines a contact position of the fixing roller and the pressure roller at the time of the irregular stop as a new stop position, and uses the new stop position as the previous contact position for a next image forming operation.

6. An image forming apparatus, comprising:

a transfer unit that transfers a toner image formed on an image carrier onto a recording medium;

a fixing unit including a fixing roller and a pressure roller that fix the toner image onto the recording medium by applying heat and pressure to the recording medium;

at least one driving unit that drives the fixing roller and the pressure roller;

a switching unit that switches on and off a driving source of the driving unit; and a control unit that performs, when stopping the fixing roller, a fixing-roller drive stop control that calculates a rotation angle difference between a current contact position and a previous contact position of the fixing roller and the pressure roller and, when the rotation angle difference is outside a predetermined range, controls the driving unit and the switching unit to stop the fixing roller such that the fixing roller and the pressure roller make a contact with each other at a contact position different from the previous contact position.

7. The image forming apparatus according to claim 6, wherein the control unit controls the driving unit to suspend a driving of the fixing roller, and performs the fixing-roller drive stop control in a state in which the driving of the fixing roller is suspended.

8. The image forming apparatus according to claim 6, wherein the control unit performs the fixing-roller drive stop control by adjusting a driving time of the fixing roller based on the calculated rotation angle difference.

9. The image forming apparatus according to claim 8, wherein the control unit performs the fixing-roller drive stop control based on an operation mode of the image forming operation.

10. The image forming apparatus according to claim 8, wherein the control unit includes a timer unit that measures a time from an irregular stop during an image forming operation, and when the time from the irregular stop continues for a predetermined time, the control unit determines a contact position of the fixing roller and the pressure roller at the time of the irregular stop as a new stop position, and uses the new stop position as the previous contact position for a next image forming operation.

11. The image forming apparatus according to claim 1, wherein the previous contact position is a contact position of the fixing roller and the pressure roller prior to an image forming operation and the current contact position is a contact position of the fixing roller and the pressure roller after the image forming operation.

12. The image forming apparatus according to claim 11, wherein the current contact position is calculated by the control unit before an end of the image forming operation.

13. The image forming apparatus according to claim 6, wherein the previous contact position is a contact position of the fixing roller and the pressure roller prior to an image forming operation and the current contact position is a contact position of the fixing roller and the pressure roller after the image forming operation.

14. The image forming apparatus according to claim 13, wherein the current contact position is calculated by the control unit before an end of the image forming operation.

15. A method of controlling an image forming apparatus, comprising:

transferring a toner image formed on an image carrier onto a recording medium;

fixing the toner image onto the recording medium by applying heat and pressure to the recording medium via a fixing roller and a pressure roller; and calculating a rotation angle difference between a current contact position and a previous contact position of the fixing roller and the pressure roller; and controlling, when the rotation angle difference is outside a predetermined range, a driving unit to stop the fixing roller such that the fixing roller and the pressure roller make a contact with each other at a contact position different from the previous contact position.

16. The method according to claim 15, wherein the previous contact position is a contact position of the fixing roller and the pressure roller prior to an image forming operation and the current contact position is a contact position of the fixing roller and the pressure roller after the image forming operation.

17. The image forming method according to claim 16, wherein the current contact position is calculated before an end of the image forming operation.

* * * * *